US011543194B2

(12) United States Patent
Berger

(10) Patent No.: US 11,543,194 B2
(45) Date of Patent: Jan. 3, 2023

(54) PROJECTILE LAUNCHER WITH BARREL BREECH LOCK MECHANISM

(71) Applicant: Rory Berger, Snohomish, WA (US)

(72) Inventor: Rory Berger, Snohomish, WA (US)

( * ) Notice: Subject to any disclaimer, the term of this patent is extended or adjusted under 35 U.S.C. 154(b) by 0 days.

(21) Appl. No.: 17/496,404

(22) Filed: Oct. 7, 2021

(65) Prior Publication Data

US 2022/0113098 A1 Apr. 14, 2022

Related U.S. Application Data

(60) Provisional application No. 63/088,738, filed on Oct. 7, 2020.

(51) Int. Cl.
*F41A 3/04* (2006.01)
*F41C 27/06* (2006.01)
*F41F 1/00* (2006.01)

(52) U.S. Cl.
CPC ..... *F41A 3/04* (2013.01); *F41C 27/06* (2013.01); *F41F 1/00* (2013.01)

(58) Field of Classification Search
CPC ..... F41A 3/04; F41C 27/06
See application file for complete search history.

(56) References Cited

U.S. PATENT DOCUMENTS 10,119,781 B1 * 11/2018 Teetzel ..... F41C 27/06
2001/0042334 A1 * 11/2001 Weichert ..... F41C 27/06 42/105
2006/0201044 A1 * 9/2006 Griffin ..... F41C 27/06 42/105
2007/0068057 A1 * 3/2007 Macaluso ..... F41C 7/11 42/105
2007/0074437 A1 * 4/2007 Compton ..... F41A 35/06 42/12
2012/0159829 A1 * 6/2012 Krutil ..... F41A 9/45 42/40

(Continued)

FOREIGN PATENT DOCUMENTS

CN 113324439 A * 8/2021

*Primary Examiner* — Gabriel J. Klein
(74) *Attorney, Agent, or Firm* — Dean A. Craine

(57) ABSTRACT

A barrel breech lock and mechanism for a projectile launcher chat uses a launcher body, a lower rail extending forward and under the launcher's barrel breech and a pivotally mounted latch plate. Extending downward extending from the latch plate is a front handgrip. Disposed between the lower rail and the latch plate and directly above the front handgrip is a locking mechanism that selectively blocks rotation of the proximal end of the latch plate. In two embodiments, the locking mechanism is a biased lateral push button or a biased sliding button. When the lock mechanism is activated, the proximal end of the latch plate may be rotated downward by a twisting force applied via the from handgrip. Disposed between the proximal end of the latch plate and the barrel breech is a second lock mechanism that includes a pin. The end of the pin engages a stop surface formed on the barrel breech when axially aligned in the breech void area. The first lock mechanism can be easily activated with the hand holding the from handgrip. Because the first and second lock mechanisms must be sequentially activated in order to open the barrel breech, the operation of the projective launcher is safer.

16 Claims, 12 Drawing Sheets

(56) References Cited

U.S. PATENT DOCUMENTS

| | | | | |
|---|---|---|---|---|
| 2014/0237883 | A1* | 8/2014 | Hosz | F41C 27/00<br>42/105 |
| 2020/0284549 | A1* | 9/2020 | Teetzel | F41A 3/04 |

* cited by examiner

PROJECTILE LAUNCHER WITH BARREL BREECH LOCK MECHANISM

This non-provisional patent application is based on and claims the filing date benefit of U.S. provisional patent application (Application No. 63/088,738) filed on Oct. 7,2020.

Notice is given that the following patent document contains original material subject to copyright protection. The copyright owner has no objection to the facsimile or digital download reproduction of all or part of the patent document but otherwise reserves all copyrights.

BACKGROUND OF THE INVENTION

1. Field of the Invention

This invention pertains to the field of projectile launchers, and more specifically, to an improved projectile launcher that is easier and safer to use than other projectile launchers.

2. Description of the Related Art

Some projectile launchers use a launcher body and a barrel breech that rotates between closed and opened positions to allow insertion and removal of a projectile into the barrel breech. The barrel breech's distal end is usually pivotally attached to the launcher body, allowing the barrel breech's proximal end to swing through a void area in front of the launch body. When a projectile is placed inside the barrel breech, the barrel breech is rotated and axially aligned with the launcher body. A lock mechanism securely holds the barrel breech axially aligned with the launcher body until the launcher is fired.

While firing a projectile launcher, the user grips the rear and front handgrips with two hands. The index finger on the hand gripping the rear handgrip operates the trigger while the other hand grips the front handgrip. Ideally, when firing multiple rounds at a target, it is important to replace the rounds quickly with minimal launcher movement.

After the launcher is fired, the projectile shell must be removed and replaced by a new projectile. One drawback with the projectile launchers described above is that the lock mechanism used to lock and unlock the barrel breech uses a release lever or button on the side of the launcher. To operate the release lever or button, the user must release his grip on the front handgrip, which delays successive firings and also causes excessive launcher movement. In addition, when firing multiple rounds at a target, excessive movement of the launcher requires the user to re-aim the launcher after each firing.

Another drawback with other types of projectile launchers found in the prior art is that the release lever or button that operates the lock mechanism is on the bottom surface of the launcher body near the trigger guard. To manipulate the release lever or button, the user must remove his trigger finger from the trigger guard. In addition, because the user often wears gloves, repeatedly moving the trigger linger in and out of the trigger guard can cause accidental firing of the launcher.

What is needed is a projectile launcher with an improved barrel breech with dual lock mechanisms that are faster and safer to use than current barrel breech locking mechanisms.

SUMMARY OF THE INVENTION

An improved projectile launcher with a rotating barrel breech with dual lock mechanisms that allow the user to quickly and safely load and exchange projectiles into the launcher's barrel breech. The projectile launcher includes a launcher body and a rotating barrel breech. The launcher body includes a rear handgrip, a trigger frame, an upper rail, a lower rail, and a front ring assembly attached to the upper rail. A from handgrip attaches to the latch plate. The barrel breech is pivotally attached to the from ring assembly, and a breech void area is created between the launcher body and the front ring assembly. The barrel breech rotates around the front ring assembly and swings into the breech void area, moving between an axially aligned position (aka the close position) and a diagonally aligned position (aka the opened position).

The improved projectile launcher includes a modified lower rail and a pivotally attached latch plate at its Lower rail's distal end. The modified lower rail is similar to lower rails used in prior art projectile launches but includes features accommodating dual locking mechanisms. The first locking mechanism is a sliding alignment pin extending upward from the latch plate's proximal end, through the lower rail, and into a stop surface formed on the barrel breech. The alignment pin is biased upward and includes a beveled head configured to automatically engage the stop surface when the barrel breech is axially aligned in the breech void area. The lower end of the alignment pin is attached or coupled to the proximal end of the latch plate so that when the proximal end of the latch plate is pulled downward, the beveled head on the alignment pin disengages the stop surface, thereby enabling the barrel breech to rotate to an open position.

As stated above, the front handgrip is attached to the latch plate, and the latch plate's distal end is pivotally attached to the lower rail. Disposed between the lower rail and the latch plate is a second lock mechanism that locks the latch plate to the lower rail and prevents the proximal end of the latch plate from rotating downward. When the second lock mechanism is activated, and a forward, twisting force is applied to the front handgrip, the proximal end of the latch plate can be forced downward causing the beveled head on the alignment pin to disengage from the stop surface on the barrel breech.

In one embodiment, the second lock mechanism is a lateral sliding push button mounted on the lower rail. The sliding push-button is attached to a post with a wing-shaped head mounted on one end. The wing-shaped head fits into a complementary-shaped latch slot formed on one side of the lower rail. The wing-shaped head is wide and partially extends into the lower rail and presses against a contact surface formed on the latch plate. Mounted on the post is a spring that biases the wing-shaped head inward so that it presses against the contact surface when an inward force is not applied to the push button. Thus, when the wing-shaped head is inserted into the latch slot, the rotational movement of the latch plate on the lower rail is prevented.

When the push-button is pushed laterally, the wing-shaped head is forces laterally and disengages from the contact surface on the latch plate. The proximal end of the latch plate can then be rotated downward.

The lateral sliding push button and wing-shaped head are replaced by an axially sliding button and latch in a second embodiment. The latch moves axially inside the lower rail to block rotation of the proximal end of the latch plate on the lower rail. In both embodiments, the push and slide buttons are located directly above the front handgrip enabling the second lock mechanisms to be activated with an index finger while gripping the front handgrip.

In both embodiments, the user must first activate the second lock mechanism and then apply a downward, twisting force to the front handgrip to rotate the barrel breech from an axially aligned, locked position inside the void cavity to a diagonally extended open position. The projectile cartridge can then be replaced in the barrel breech. When the bottoms on the second lock mechanism are released and the downward twisting action on the front handgrip is discontinued, the first lock mechanism automatically engages the barrel breech when the barrel breech is realigned in the void area. Because the buttons on the second lock mechanism are located directly above the front handgrip, the user can continuously grip the front handgrip.

DESCRIPTION OF THE PREFERRED EMBODIMENT(S)

Figure 1:
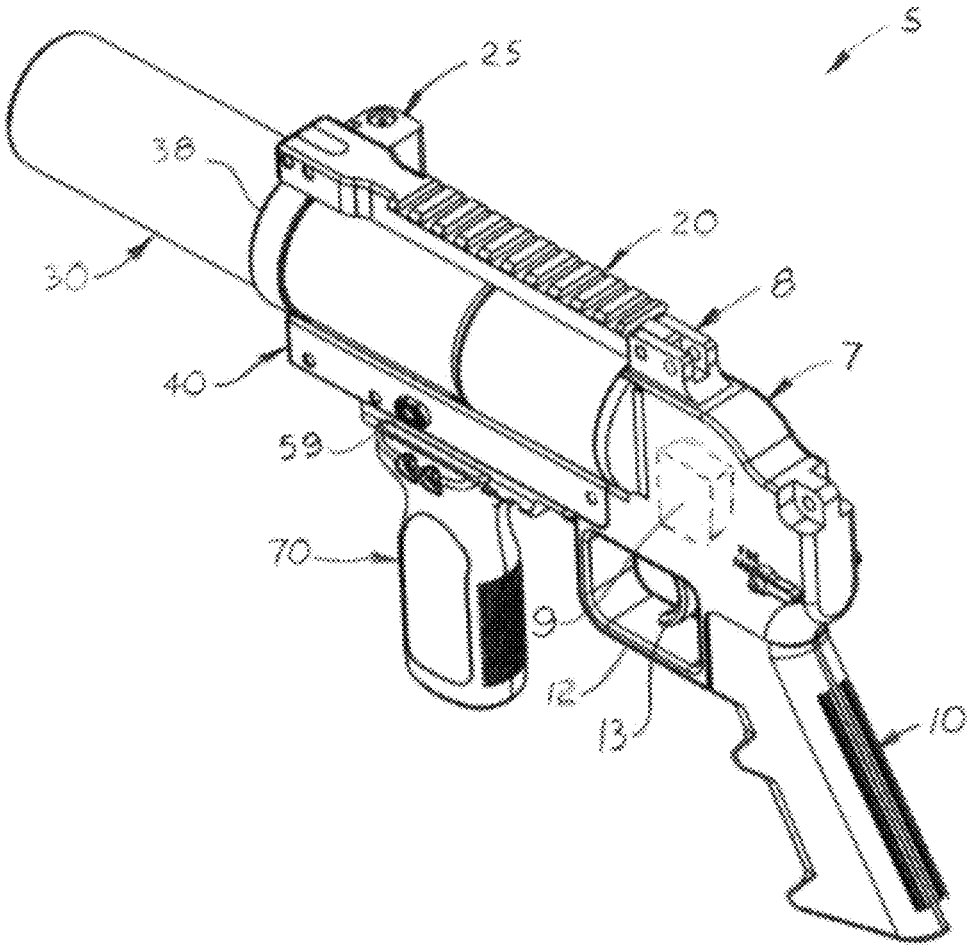
FIG. 1 is a rear top perspective view of the projectile launcher disclosed herein, showing the barrel breech in a closed position.

The FIGS. show a projectile launcher 5 that includes a launcher body 7 with a firing pin assembly 9 coupled to a trigger 13 located in a trigger guard 12. Integrally formed or attached to the launcher body 7 is a rear handgrip 10.

Figure 3:
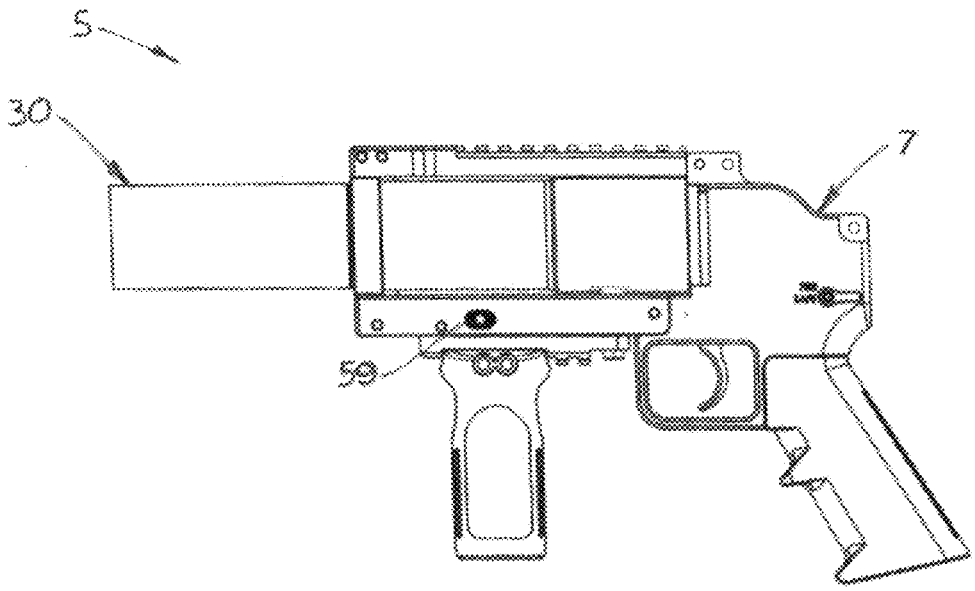
FIG. 3 is a left-side elevational view of the projectile launcher shown in FIG. 1.
Figure 4:
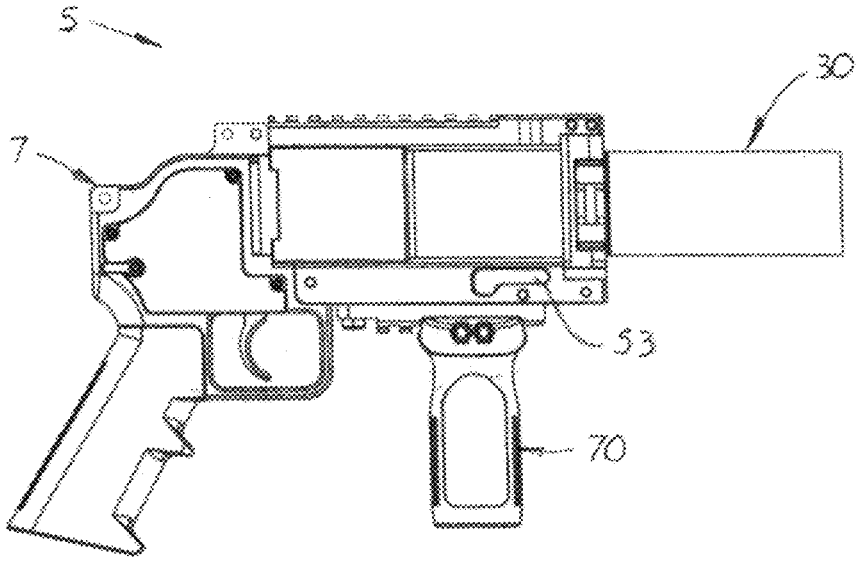
FIG. 4 is a right-side elevational view of the projectile launcher shown in FIG. 1.
Figure 5:
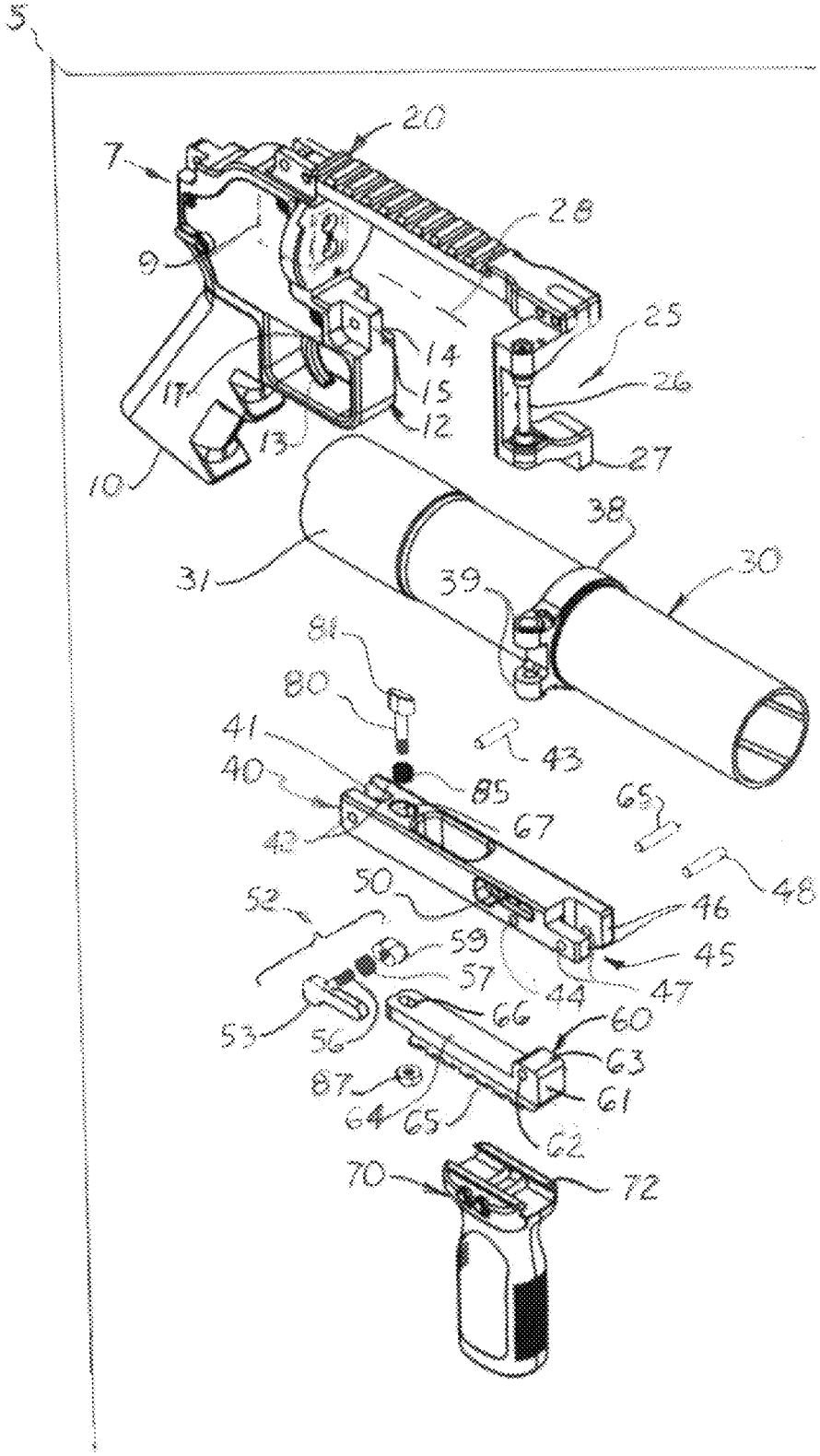
FIG. 5 is an exploded front top perspective of the projectile launcher shown in FIG. 1.
Figure 6:
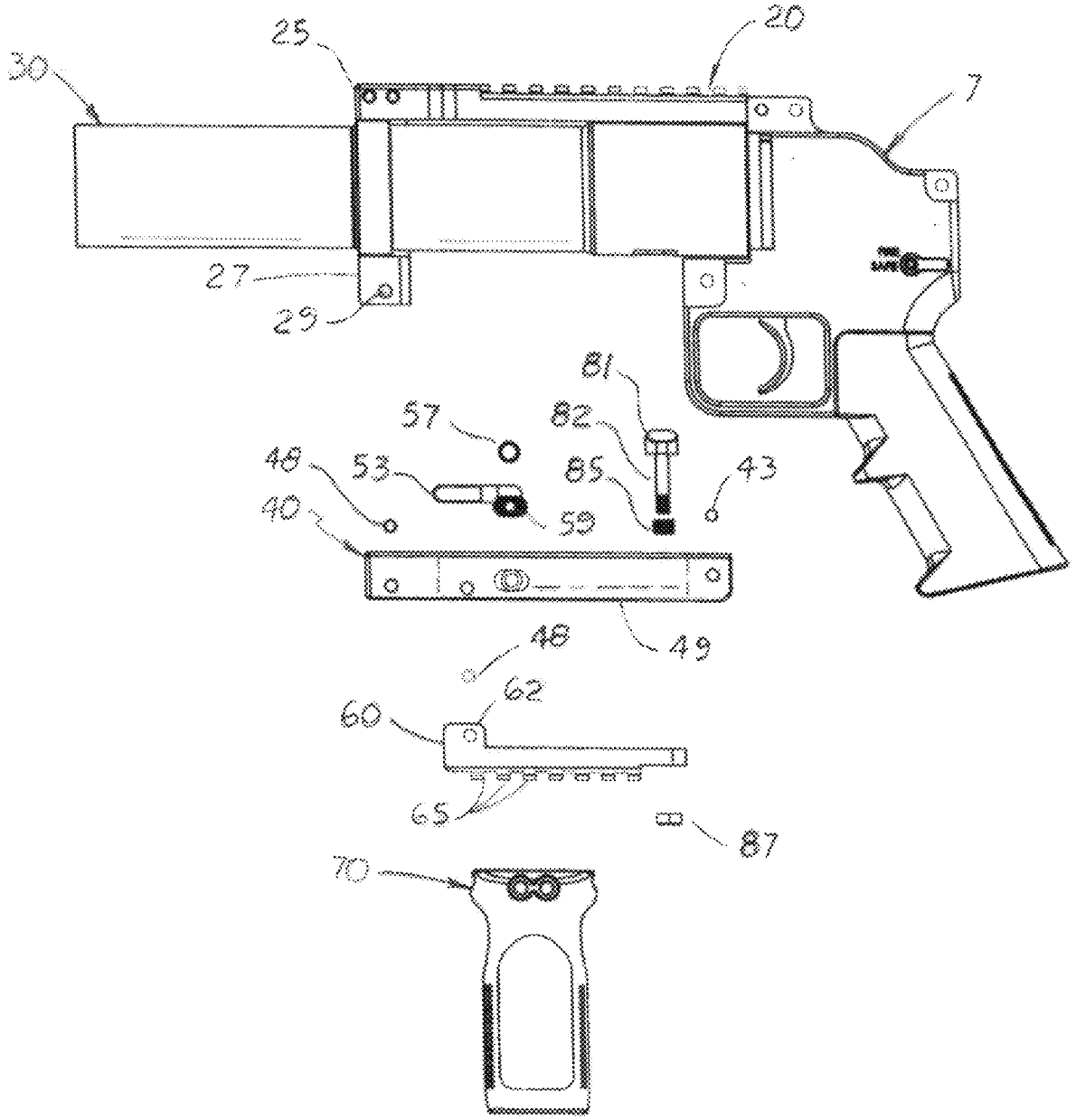
FIG. 6 is an exploded left side elevational view of the projectile launcher shown in FIG. 1

Formed on the top surface of the launcher body 7 is top bracket 8 that attaches to an axially aligned upper rail 20. The upper rail 20 extends forward front the launcher body 7 and attaches to a front bracket 25. As shown more clearly in FIG. 3, the front bracket 25 extends downward from the distal end of the upper rail 20 and includes a vertically aligned axle 26. Formed on the lower section of the from bracket 25 is a lower support 27.

The space formed below the upper rail 20 and in front of the launcher body 7 is empty, forming a breech void area 28. The breech void area 28 is configured to receive the rear section 31 of the barrel breech 30 when the barrel breech 30 is axially aligned with the launch body 1, as shown in FIG. 1.

Attached to the barrel breech 30 near its mid-line axis is a clamping bracket 38. The clamping bracket 38 includes two ears 39 that receive the vertical aligned axle 26 attached to the front bracket 25 to pivotally connect the barrel breech 30 to the front bracket 25. The clamping bracket 38 is located on the barrel breech 30 so that the rear section 31 of the barrel breech 30 fits into the breech void area 28.

As stated above, trigger 13 is mounted inside a trigger guard 12. Formed on the top surface of the trigger guard 12 are two cutout areas 14 located on opposite sides of a center support 15. Formed in the center support 15 is a bore 17.

Extending forward from the trigger guard 12 is art elongated lower rail 40. The lower rail 40 includes a center slot 41 located between two axially extending arms 42. The center slot 41 is configured to receive the center support 15 formed on the trigger guard 12. Formed on each arm 42 is a bore coaxially aligned with bore 17 when the center support 15 is inserted into the center slot 41. A pin 43 is inserted into tire bores to lock the proximal end of the lower rail 40 to the launcher body 7.

The distal end of the lower rail 40 is attached to the lower support 27 on the front bracket 25. Formed on the distal end of the lower rail 40 is a wide slot 45 configured to receive the lower support 27. Formed in the front bracket 25 is a bore 29. Surrounding the wide slot 45 are two forward extending arms 46, each with a bore 47 configured to receive a front pin 48. During assembly, front pin 48 is inserted into the bores 29 and 47 to connect the distal end of the lower rail 40 to the front bracket 25. Formed inside the lower rail 40 is an internal cavity 49. Formed near the proximal end of the lower rail 40 is an alignment pin bore 44.

Located under the lower rail 40 is a latch plate 40 that includes an upward extending head section 61 and an elongated, flat tail section 64. The head section 61 is configured to partially extend into an internal cavity 49 formed inside the lower rail 40. Formed on the head section 61 is a bore 62 aligned and registered with two bores 44. Also formed on the head section 61 is a flat, horizontal contact surface 63. In the embodiment shown, the contact surface 63 is parallel to the longitudinal axis of the latch plate 60. A pin 65 extends into the bores 44, 62 to pivotally attach the head section 61 to the lower rail 40.

Formed near the proximal end of the latch plate 60 is an alignment pin bore 66 vertically aligned with the alignment pin bore 67 formed on the lower rail 40. Formed on the bottom surface of the latch plate 60 is a plurality of teeth 65 configured to be connected to teeth 72 formed on the top surface of the front handgrip 70.

During assembly, the latch plate 60 is stacked under the lower rail 40 and the head section 61 is attached to the lower rail 40. The alignment pin bores 66, 67 are coaxially aligned and an alignment pin 80 extends through them.

Figure 7:
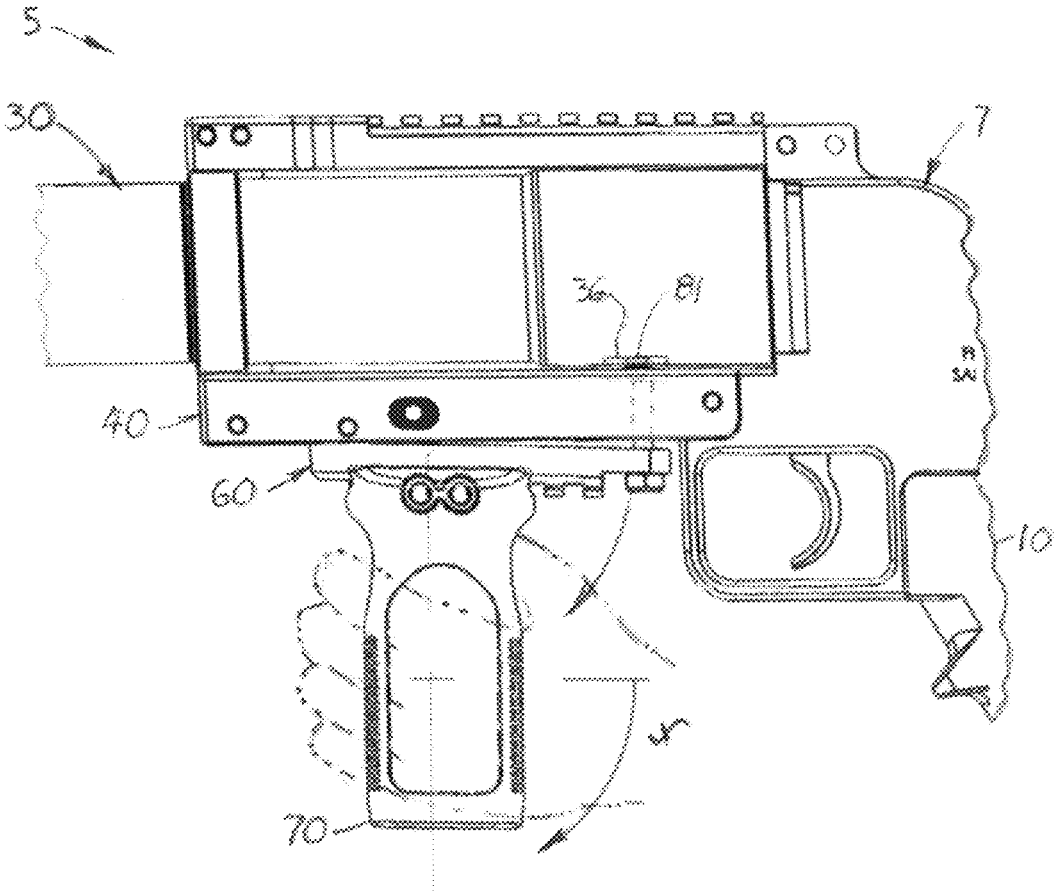
FIG. 7 is a partial left side elevational view showing the user applying a downward twisting force on the front handgrip that forces the proximal end of the latch plate downward.
Figure 8:
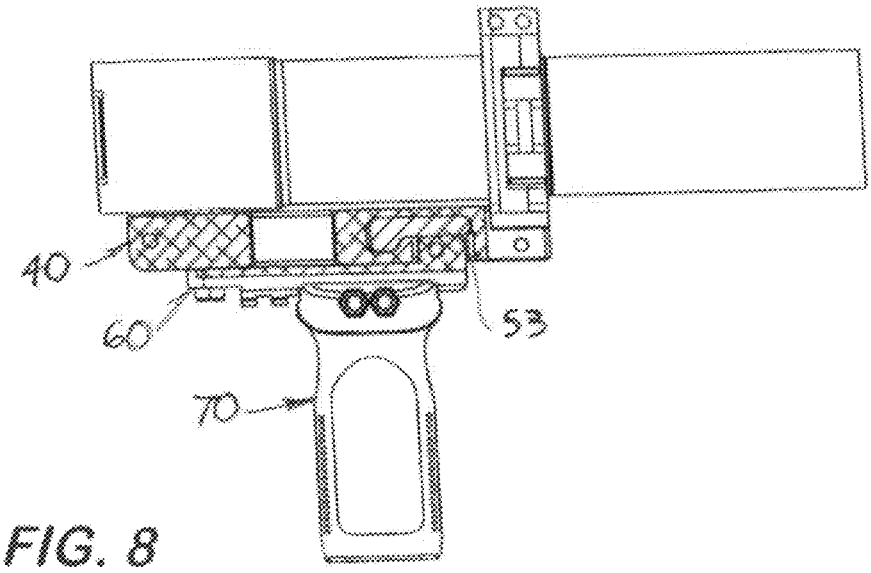
FIG. 8 is a sectional side elevational view of the launcher showing the relative location of the wing-shaped head in a blocking position over a stop surface on the lower rail.
Figure 9:
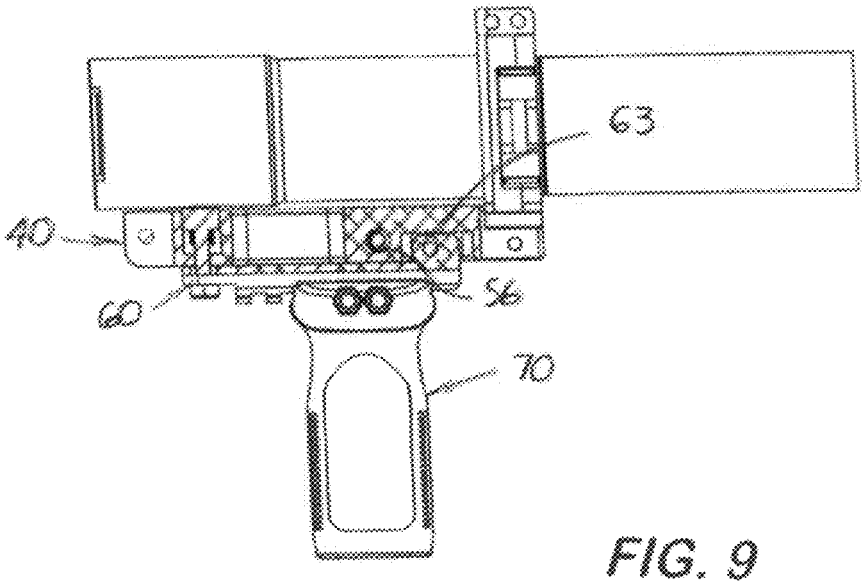
FIG. 9 is a sectional side elevational view of the launcher showing the relative location of the push-button rod and the alignment pin in the lower rail.
Figure 10:
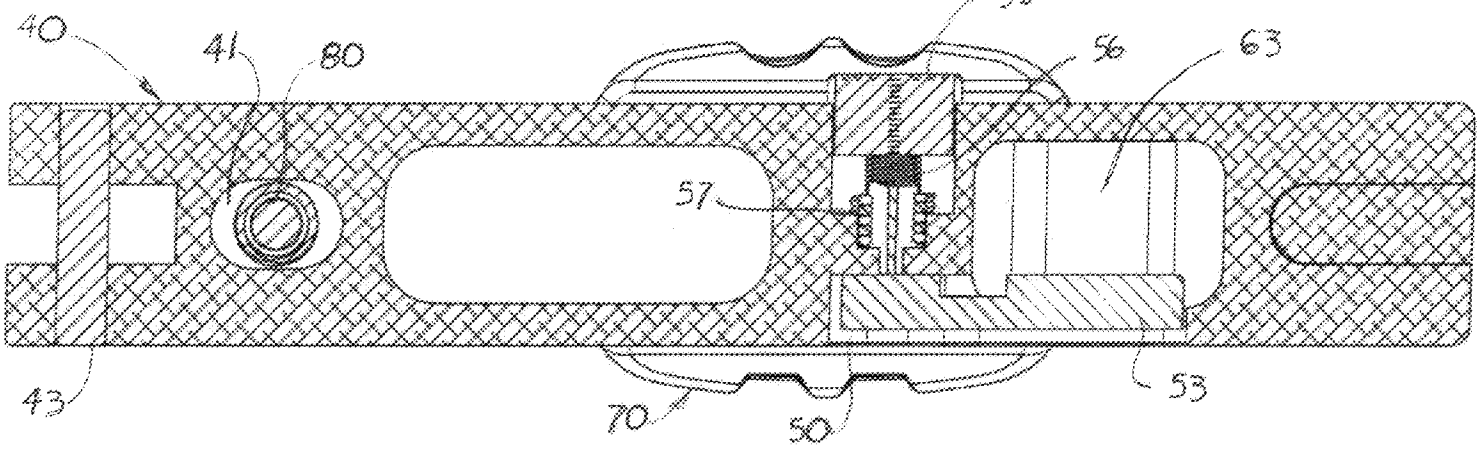
FIG. 10 is an enlarged, top sectional view of the lower rail showing the relative locations of the wing-shaped head attached to a post, a spring attached to the post, and a push-button attached to the opposite end of the post that, when pressed, move the head to a non-blocking location.
Figure 11:
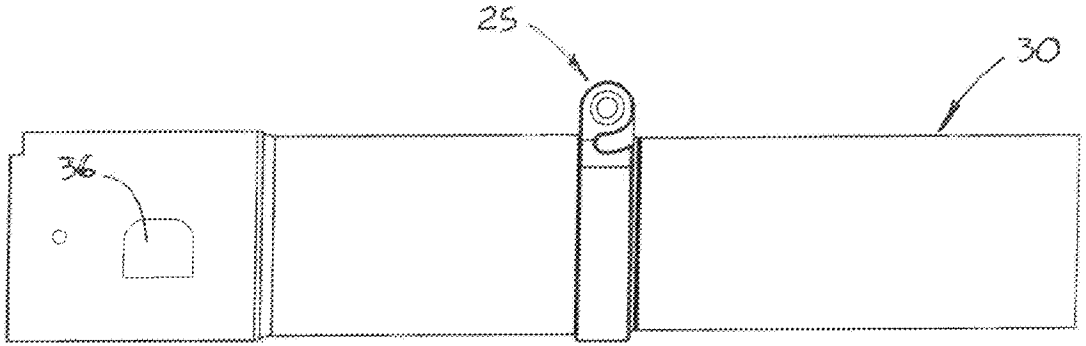
FIG. 11 is a bottom plan view of the barrel breech showing the stop surface formed on the bottom surface of the barrel breech.
Figure 12:
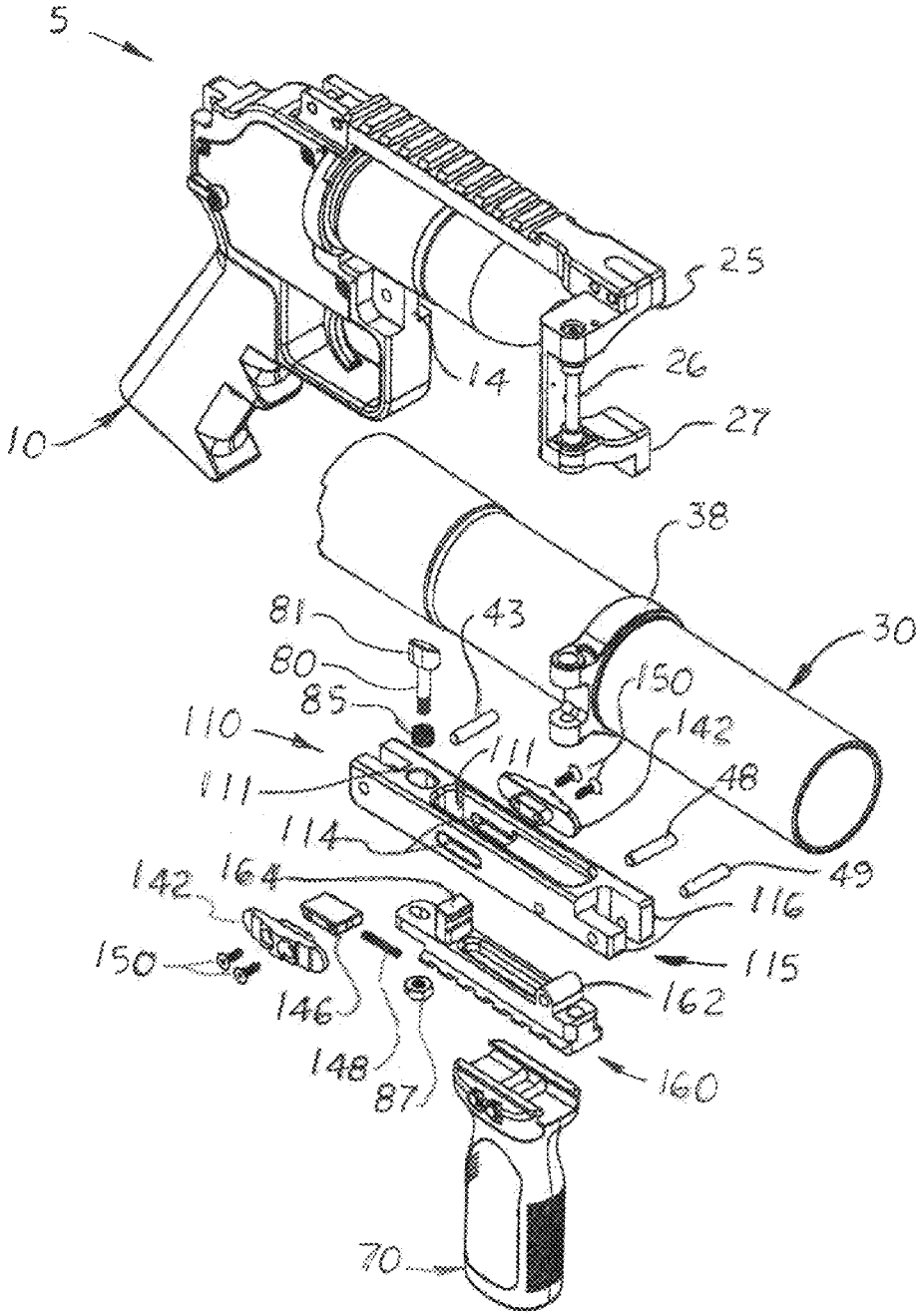
FIG. 12 is an exploded front top perspective of the projectile launcher with a second embodiment of the second locking mechanism that uses an axially sliding latch that blocks rotational movement of the latch plate
Figure 13:
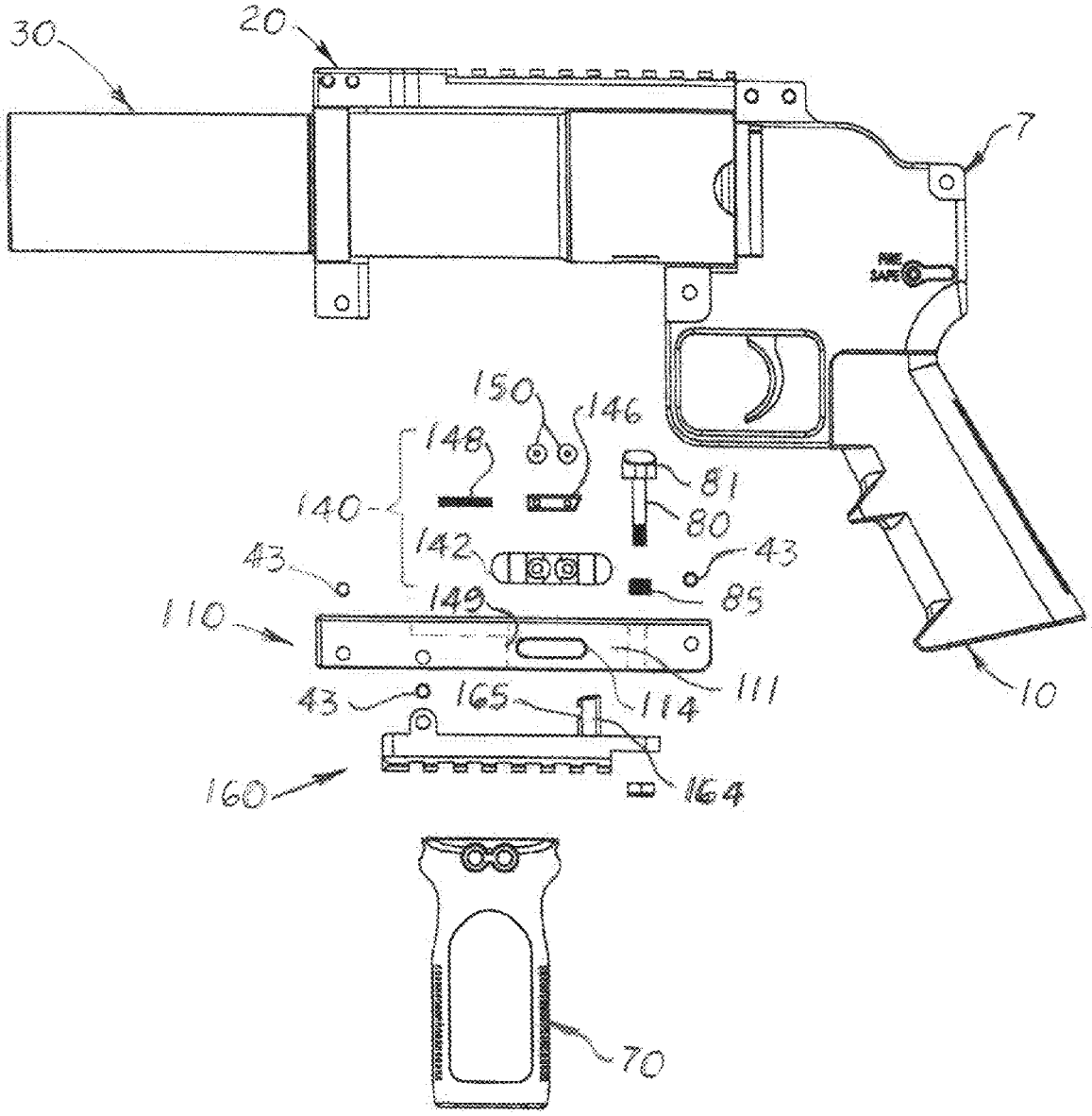
FIG. 13 is an exploded left side elevational view of the projectile launcher shown in FIG. 12.
Figure 14:
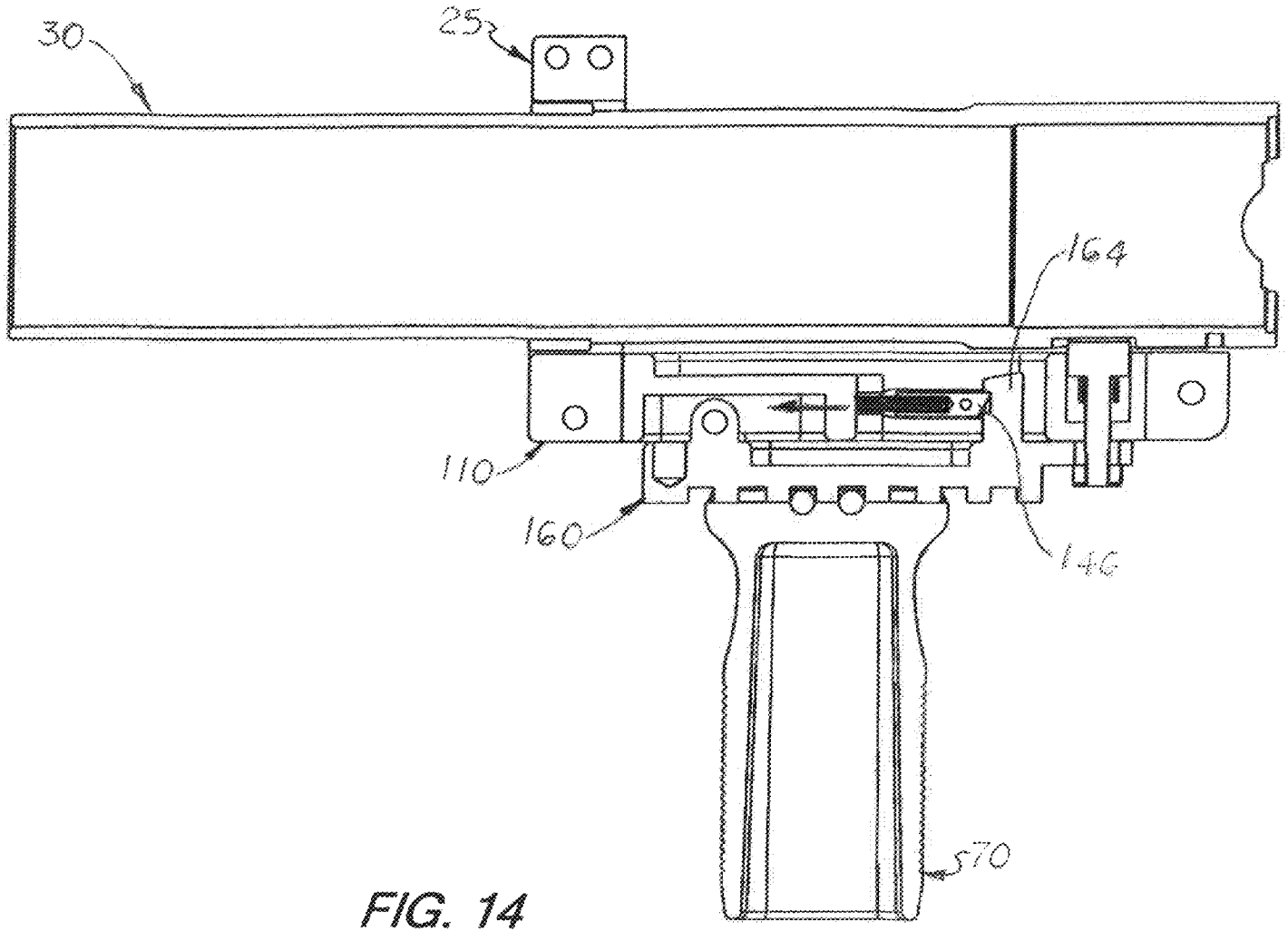
FIG. 14 is an enlarged left side elevational view of the projectile launcher shown in FIG. 13 shown the latch moved forward to disengage a stop surface on the vertical post formed or attached to the latch plate.
Figure 15:
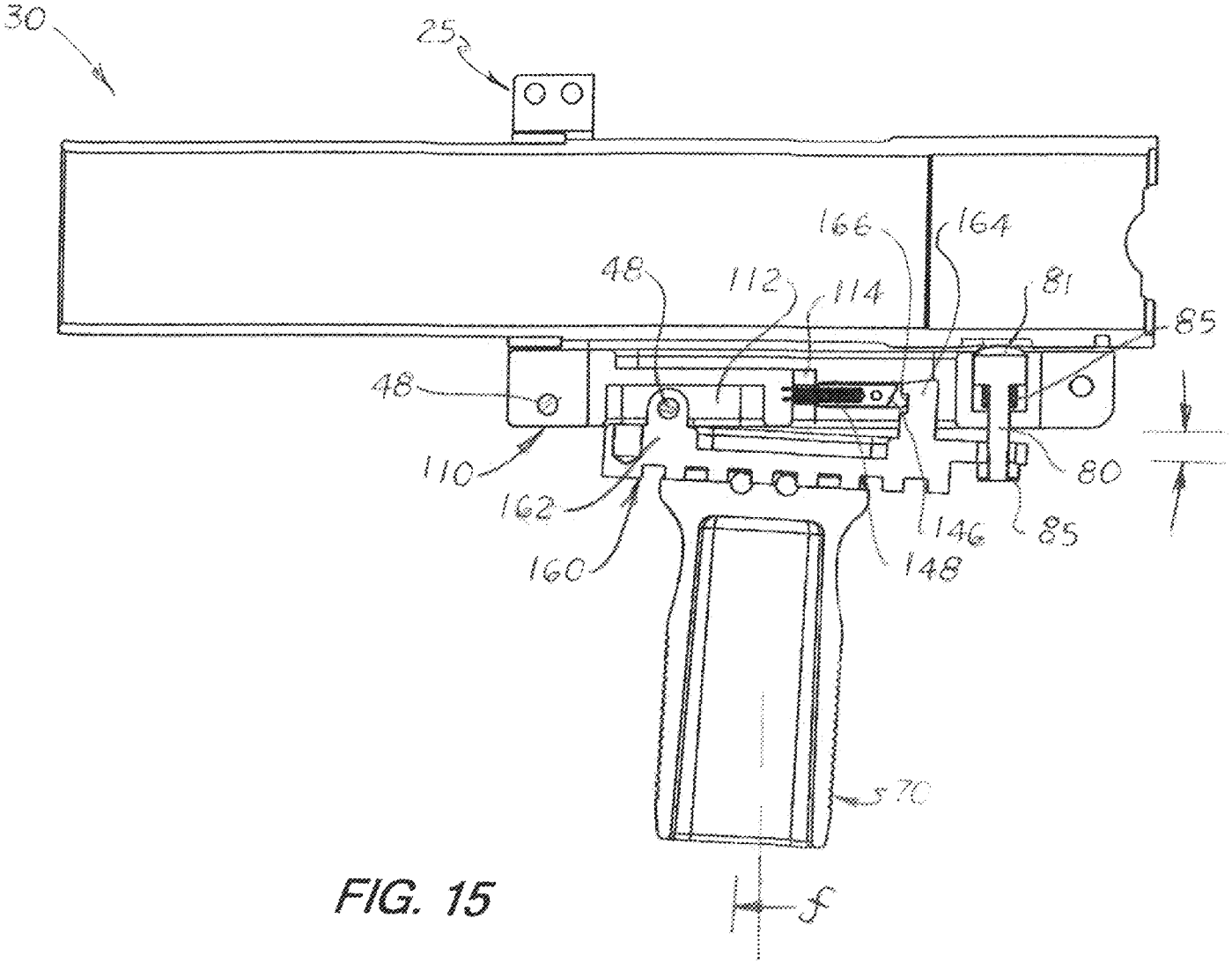
FIG. 15 is an enlarged left side elevational view of the projectile launcher similar to the view shown in FIG. 14, showing a downward twisting force being applied to the front handgrip and causing the alignment pin to disengage from the barrel breech.

The upper end of the alignment pin 80 is attached to a beveled end cap 81 configured to extend into a stop surface 36 formed on the bottom surface of the barrel breech 30 when the barrel breech 30 is in a closed position (see FIG. 7). The length of the pin 80 is sufficient to extend through the lower rail 40 and through the latch plate 60. Attached to the exposed end of the alignment pin 80 is a threaded nut 87. Disposed around the alignment pin 80 is a spring 85 that biases the beveled end cap 81 upward so that the beveled end cap 81 extends into the stop surface 36 when the barrel breech 30 is rotated to a closed, axially aligned position. The spring 85 also forces the latch plate 60 upward against the lower rail 40.

Disposed between the lower rail 40 and the latch plate 60 is a latch plate lock mechanism that prevents the proximal end of the latch plate 60 from rotating downward from the lower plate 40. When the latch plate lock mechanism is disengaged, the proximal end of the latch plate 60 can be forced downward.

In one embodiment shown in FIGS. 1-11, the latch plate locking mechanism comprises a lateral sliding push button 59 mounted on the end of a post 56. Attached to the opposite end of the post 56 is a wing-shaped head 53. The wing-shaped head 53 fits into a complementary-shaped latch slot 50 formed on one side of the lower rail 40. The wing-shaped head 53 is wide so that it partially extends into the lower rail 40 and presses against a contact surface 63 formed on the head section 61 on the latch plate 60. Mounted on the post 56 is a spring 57 that biases the wing-shaped head 53 inward so that it presses against the contact surface 63 when an inward force is not applied to the push button 59. Thus, when the wing-shaped head 53 is inserted into the latch slot 50, the rotational movement of the latch plate 60 on the lower rail 40 is prevented.

When the push-button 59 is pushed laterally, the wing-shaped head 53 is forced laterally and disengages from the contact surface 63 on the latch plate 60. The proximal end of the latch plate 60 can then be manually rotated downward.

Figure 2:
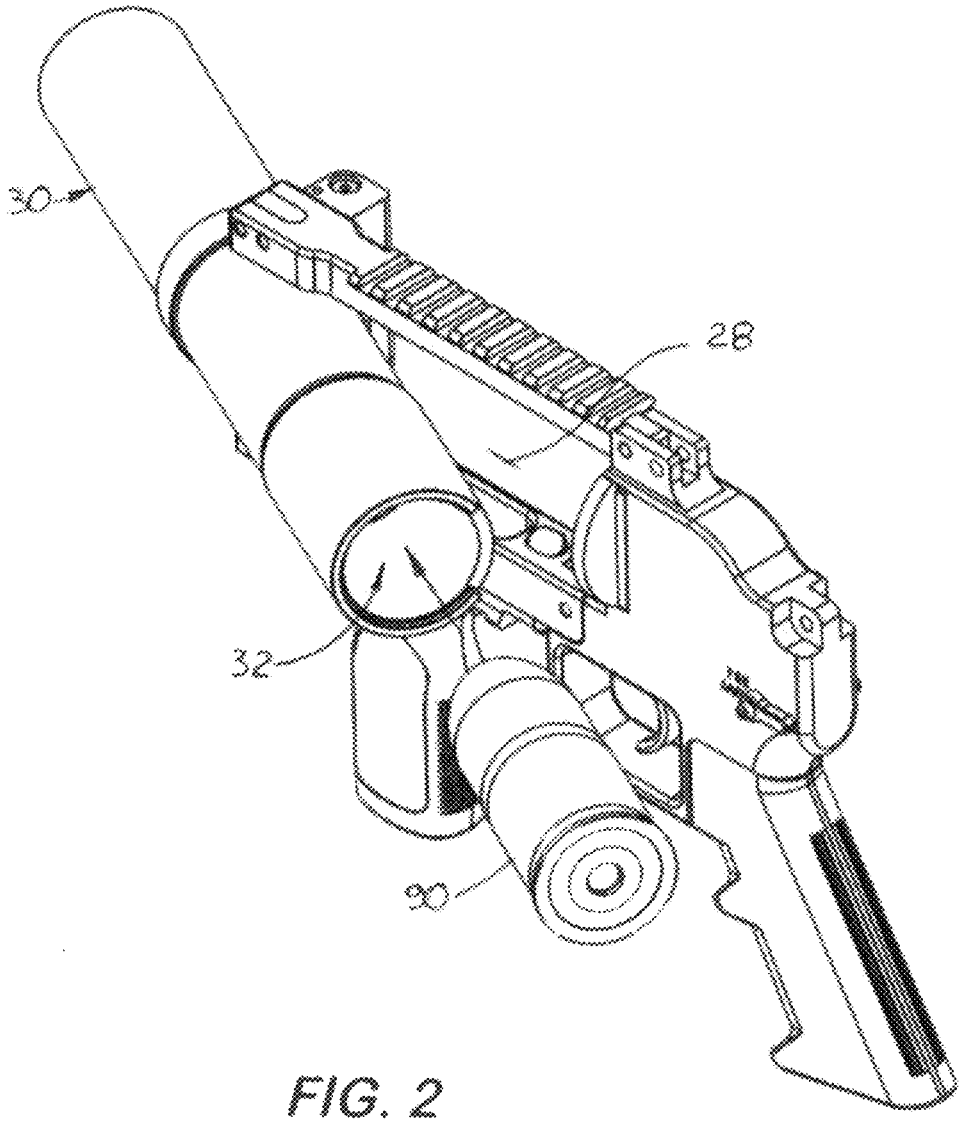
FIG. 2 is a rear top of the projectile launcher shown in FIG. 1 with the barrel breech in an open position.

During use, the barrel breech 30 is rotated on the launcher 5 so that the rear opening 32 of the barrel breech 30 is exposed, as shown in FIG. 2. The user then places a projectile 90 into the rear opening 32 and rotates the barrel breech 30 to a closed position, as shown in FIG. 1. The user then grasps the rear and front handgrips 10, 70, respectively, aims and pulls the trigger 13 to launch the projectile 90. To remove the spent cartridge front the barrel breech 30, foe user presses the push button 59 inward, which forces the wing-shaped head 53 outward through the safety latch bore 50 formed on the side of the lower rail 40. When the head 53 clears the contact surface 63, the user then applies a downward twisting force on the front handgrip 70, as shown in FIG. 7. Enough force is applied to the front handgrip 70 to force the proximal end of the latch plate 60 downward. As the proximal end of the latch plate 60 is forced downward, the alignment pin 80 is pulled down so that beveled end cap 81 is retracted from the stop surface 36 on the barrel breech 30 thereby allowing the barrel breech 30 to rotate to a diagonally aligned position so that the projectile cartridge may be removed and replaced with a new projectile 90.

FIGS. 12-16 show a projectile launcher 5 with an alternative latch plate lock mechanism used to prevent a modified latch plate 160 from rotating under a modified lower rail 110. The modified latch plate 160 includes an upward extending hinge body 162 that fits inside the center slot 115 formed on the lower rail 110. The modified latch plate 160 also includes a upward extending rear post 164 with a support The alternative lock mechanism includes a sliding safety latch 146 is located inside the lower rail 110 near the lower rails' center, transverse axis. The opposite sides of the latch 146 are attached to two end caps 142 via screws 150. During operation, the latch and the two end caps side as a single unit inside the two slide slots 114 formed on the sides of the lower rail 110. The latch 146 is attached to a spring 148 used to provide a biasing force on the latch 146 to hold the latch axially on the mounting surface located inside the lower rail 110.

During use, the user slides the two end caps 142 longitudinally in a forward direction. The end of the latch 146 disengages a slot 165 formed on the inside surface of rear post 164 on the latch plate 160. During assembly, the rear post 164 extends into a center cavity formed inside the lower rail 110.

The modified lower rail 110 includes a vertical support surface located inside the center cavity. During assembly, the spring 148 presses against the support surface which biases the latch 146 rearward.

The user then applies a downward twisting force on the from handgrip 70 which causes the latch plate 160 to rotate around pin 48. When downward twisting force is applied to the front handgrip 70, the proximal end of the latch plate 160 drops and pulls the alignment pin 80 downward. When the beveled head 81 of the alignment pin 80 clears the stop surface 36 on the barrel breech 30, the barrel breech 30 can rotate to an open position.

Like the first embodiment, the user uses one hand to remove the spent cartridge and insert a new round 90 into the barrel breech 30. When the downward twice force is discontinued on the front handgrip 70, the beveled head 81 on the alignment pin 80 s pulled downward. The barrel breech 30 can then be rotated to an open position. When the user releases the front handgrip 70 and releases the two end caps 142, the latch plate 160 returns to its original position and the two end caps 142 automatically returned to their original positions. The latch 146 automatically reengages the slot 165 formed on the rear post 164 to hold the latch plate 160 against the bottom surface of the lower rail 110.

In compliance with the statute, the invention described has been described in language more or less specific as to structural features. However, it should be understood that the invention is not limited to the specific features shown, since the means and construction shown comprises the preferred embodiments for putting the invention into effect. Therefore, the invention is claimed in its forms or modifications within the legitimate and valid scope of the amended claims, appropriately interpreted under the doctrine of equivalents.

I claim:

1. A projectile launcher that includes a launcher body containing a firing pin assembly or a valve assembly, a primary handgrip integrally formed or attached to the launcher body, an upper rail, a front ring assembly attached to the upper rail, a barrel breech, and a breech void area between the launcher body and the front ring assembly, the barrel breech being pivotally connected to the front ring assembly and configured to fit inside the breech void area so that the barrel breech may be axially aligned with the launcher body, the projectile launcher further comprising;

a. a stop surface formed on the barrel breech;

b. a lower rail extendingly mounted on the launcher body and under the breech void area, the lower rail includes a distal end and a proximal end;

c. a latch plate axially aligned with and located under the lower rail, the latch plate being pivotally attached to the distal end of the lower rail;

d. an alignment pin coupled to the latch plate and extending through the lower rail, the alignment pin configured to engage the stop surface formed on the barrel breech when the latch plate is axially aligned with the lower rail and the barrel breech is axially aligned in the breech void area, the alignment pin being configured to disengage the stop surface on the barrel breach when a proximal end of the latch plate is rotated downward;

e. a front handgrip attached to said latch plate;

f. a first lock mechanism disposed between the lower rail and the latch plate, the first lock mechanism configured to automatically lock the latch plate in axial alignment with said lower rail and configured to be selectively moved to unlock the latch plate from the lower rail to enable the proximal end of the latch plate to be forcibly pulled downward from the lower rail using the front handgrip; and g. a second lock mechanism located between the latch plate and the lower rail, the second lock mechanism includes a biased blocking member configured to prevent rotation of the proximal end of the latch plate from the lower rail, the blocking member being attached to a button located on the lower rail and above tire front handgrip, when the button is moved on the lower rail, the blocking member moves to an unblocking location thereby enabling the proximal end of the latch plate to rotate downward.

2. The projectile launcher as recited in claim 1, wherein said first lock mechanism is a laterally sliding arm that includes a wing-shaped head that extends into the lower rail and presses against a contact surface formed on said latch plate, said wing-shaped head and contact surface configured to block rotation of the latch plate, when said wing-shaped head is forced laterally on said lower rail, the wing-shaped head is removed from said contact surface thereby enabling the proximate end of the latch plate to rotate.

3. The projectile launcher as recited in claim 2, wherein the wing-shaped head is attached to a post with a button attached to the opposite end, the post and button being sufficient to extend outward from the lower rail on a side opposite the wing-shaped head enabling the wing-shaped head to be manually forced laterally on the lower rail.

4. The projectile launcher as recited in claim 3, further including a spring configured to bias the wing-shaped head inward and block rotational movement of the latch plate when inward pressure on the button is released.

5. The projectile launcher as recited in claim 1, wherein the first locking mechanism is a longitudinal sliding member located inside the lower rail, the sliding member is connected to at least one sliding button mounted on the side of the lower rail, the sliding member configured to engage a stop surface formed on the latch plate and prevent downward rotation of the proximal end of the latch plate from the lower rail.

6. The projectile launcher as recited in claim 5, further including the latch plate with an upward extending post configured to extend into a cavity formed on the lower rail, the stop surface being formed on the post.

7. The projectile launcher as recited in claim 6, further including a spring coupled to said sliding member configured to force the sliding member to a position that blocks rotational movement of the latch plate on said lower rail.

8. A projectile launcher comprising:

a. a launcher body containing a firing pin assembly or a valve assembly;

b. a primary handgrip integrally formed or attached to die launcher body;

c. a front ring assembly located in front of the launcher body forming a breech void area between the launcher body and the front ring assembly:

d. the barrel breech being pivotally connected to the front ring assembly and configured to fit inside the breech void area so that the barrel breech may be axially aligned with the launcher body;

e. a lower rail extendingly mounted on the launcher body and under the breech void area, the lower rail includes a distal end and a proximal end;

f. a latch plate located under the lower rail, the latch plate being pivotally attached at one end to the distal end of the lower rail enabling an end of the latch plate opposite the end pivotally attached to the lower rail to rotate downward front the lower rail;

g. a first lock mechanism attached to the latch plate and extending upward to engage the barrel breech, the first lock mechanism includes an upward biased alignment pin that extends upward from a proximal end of the latch plate and engages the barrel breech and blocks rotation of the barrel breech when the barrel breech is axially aligned in the breech void area, when the proximal end of the latch plate is rotated downward, the alignment pin is also pulled downward and disengages the barrel breech enabling the barrel breech to rotate in the breech void area;

h. a second lock mechanism located between the latch plate and the lower rail, the second lock mechanism includes a biased blocking member configured to prevent rotation of the proximal end of the latch plate from the lower rail, the block member being attached to a button located on the lower rail and above a front handgrip when the button is moved, the blocking member moves to an unblocking location thereby enabling the proximal end of the latch plate to rotated downward.

9. The projectile launcher as recited in claim 8, wherein said alignment pin includes a beveled head and a stop surface formed on the barrel breech, the beveled head configured to automatically engage the stop surface and prevent rotation of the barrel breech when and the barrel breech is axially aligned in the breech void area.

10. The projectile launcher as recited in claim 8, wherein said alignment pin extends through the lower rail.

11. The projectile launcher as recited in claim 8, wherein the biased blocking member on the second lock mechanism is a wing-shaped end piece attached to said lower rail, the wing-shaped end piece configured to slide laterally in the lower rail and move between a latch plate rotation blocking position and a latch plate unblocking position.

12. The projectile launcher as recited in claim 3, wherein the wing-shaped end piece is attached to one end of a post that extends transversely inside said lower rail, a button attached to an opposite end of the post, the end piece, post and button configured to move the wing-shaped end piece laterally in the lower rail to the latch plate unblocking position when inward force is applied to the button.

13. The projectile launcher as recited in claim 12, further including a spring that at biases the wing-shaped end piece inward on the lower rail to a blocking position when a button is released.

14. The projectile launcher as recited in claim 8, wherein the biased blocking member on the second lock mechanism is as longitudinal sliding member located inside the lower rail, the sliding member is connected to at least one sliding button mounted on the side of the lower rail, the sliding member configured to engage a stop surface formed on the latch plate and prevent downward rotation of the proximal end of the latch plate from the lower rail.

15. The projectile launcher as recited in claim 14, further including the latch plate with an upward extend post configured to extending into a cavity formed on the lower rail, the stop surface being formed on the post.

16. The projectile launcher as recited in claim 14, further including a spring coupled to said sliding member configured to force the sliding member to a position that blocks rotational movement of the latch plate on said lower rail.

* * * * *